US012134966B2

(12) United States Patent
Wen et al.

(10) Patent No.: US 12,134,966 B2
(45) Date of Patent: Nov. 5, 2024

(54) UNDERGROUND GASIFIER PRE-CONTROL STRUCTURE, GASIFIER AND GASIFICATION METHOD

(71) Applicant: SHANDONG UNIVERSITY OF SCIENCE AND TECHNOLOGY, Qingdao (CN)

(72) Inventors: Zhijie Wen, Qingdao (CN); Jing Huang, Qingdao (CN); Peng Xiao, Qingdao (CN); Jingkai Zhang, Qingdao (CN); Hengzhong Zhu, Qingdao (CN)

(73) Assignee: SHANDONG UNIVERSITY OF SCIENCE AND TECHNOLOGY, Qingdao (CN)

( * ) Notice: Subject to any disclaimer, the term of this patent is extended or adjusted under 35 U.S.C. 154(b) by 244 days.

(21) Appl. No.: 17/786,596

(22) PCT Filed: Nov. 26, 2020

(86) PCT No.: PCT/CN2020/131625
§ 371 (c)(1),
(2) Date: Jun. 17, 2022

(87) PCT Pub. No.: WO2021/179684
PCT Pub. Date: Sep. 16, 2021

(65) Prior Publication Data

US 2023/0008988 A1 Jan. 12, 2023

(30) Foreign Application Priority Data

Mar. 9, 2020 (CN) ..... 202010155367.6

(51) Int. Cl.
*E21B 43/295* (2006.01)

(52) U.S. Cl.
CPC ..... *E21B 43/295* (2013.01)

(58) Field of Classification Search
CPC ..... E21B 43/295; E21B 43/30; E21B 43/2408
See application file for complete search history.

(56) References Cited

U.S. PATENT DOCUMENTS 5,287,926 A * 2/1994 Grupping ..... E21F 15/08 166/50
2010/0012331 A1* 1/2010 Larter ..... E21B 43/243 166/401

(Continued)

FOREIGN PATENT DOCUMENTS

CN 103821484 A 5/2014
CN 205936569 U 2/2017

(Continued)

OTHER PUBLICATIONS

International Search Report issued in International Application No. PCT/CN2020/131625; mailed Jan. 28, 2021; 8 pgs.

(Continued)

*Primary Examiner* — Carib A Oquendo
(74) *Attorney, Agent, or Firm* — HAUPTMAN HAM, LLP

(57) ABSTRACT

An underground gasifier pre-control structure includes a flame retardant injection system. The flame retardant injection system includes a flame retardant injection shaft pipe channel drilled from ground to a coal seam and a flame retardant injection channel located in the coal seam. The flame retardant injection channel includes a first flame retardant injection channel and a second flame retardant injection channel at both sides of each gasifier and a third flame retardant injection channel located in a horizontal direction of an adjacent gasifier. The first flame retardant injection channel includes a horizontal section along a strike of the coal seam and a bypass section offset toward the gasifier. The flame retardant injection system forms a wet coal wall in the coal seam to achieve pre-control for the (Continued)

gasifier. The pre-control structure wets the coal masses at both sides of the gasifier and the gasifier does not spread toward both sides.

5 Claims, 3 Drawing Sheets

(56) References Cited

U.S. PATENT DOCUMENTS

| | | | | |
|---|---|---|---|---|
| 2015/0107833 | A1* | 4/2015 | Boone | E21B 43/2408 166/272.3 |
| 2016/0194945 | A1* | 7/2016 | Chen | E21B 43/006 299/4 |

FOREIGN PATENT DOCUMENTS

| | | | |
|---|---|---|---|
| CN | 107701166 | A | 2/2018 |
| CN | 207568580 | U | 7/2018 |
| CN | 111173491 | A | 5/2020 |

OTHER PUBLICATIONS

Written Opinion issued in International Application No. PCT/CN2020/131625; mailed Jan. 28, 2021; 9 pgs.

* cited by examiner

UNDERGROUND GASIFIER PRE-CONTROL STRUCTURE, GASIFIER AND GASIFICATION METHOD

RELATED APPLICATIONS

The present application is a U.S. National Phase of International Application Number PCT/CN2020/131625 filed Nov. 26, 2020 and claims priority to Chinese Application Number 202010155367.6 filed Mar. 9, 2020.

TECHNICAL FIELD

The present invention relates to the field of underground coal gasification technologies and in particular to an underground gasifier pre-control structure, a gasifier and a gasification method.

BACKGROUND

Chinese energy system is facing double challenges, that is, the energy system needs to adapt to the requirements of social low-carbon green development while satisfying the increasing requirements for Chinese energy consumption. China has the resource distribution characteristics of more coals and less gas, and needs to carry out the green extraction concept of clean efficient utilization of coals. Therefore, the underground coal gasification technology becomes particularly important in China with large coal reserve and large gas consumption. Additionally, the underground coal gasification technology is also one of multiple approaches to relieve the shortage of the gas sources of China.

Compared with traditional physical coal extraction, the underground coal gasification is a new process for coal extraction. The underground coal gasification features low cost, high efficiency, high resource extraction rate, stable operation and small environmental impact, and may be used to extract coal resources that cannot be extracted by using traditional method. But, the underground coal gasification technology is still not put into industrial applications after more than 80 years of site tests and one of the bottleneck technologies that it faces is that the structure of the gasifier is difficult to control. At present, the carrier of the underground coal gasifier is a geological body and the morphology and the structure of the coals during gasification and combustion in the formation cannot be controlled, resulting in uncontrolled development and spread of the structure of the gasifier. When the internal space of the gasifier is too large, a coal mass may be heated and broken, a surrounding rock stress increases and overlying strata collapses. In this case, normal operation of the underground coal gasifier will be directly affected. For example, the patent CN107701166A discloses an underground coal gasifier with anti-high-temperature well cementing technology using double-layer standard petroleum casing, which has not solved the problem of the pre-control of a cavity structure of the gasifier.

SUMMARY

In order to solve the technical defects of inability to control the morphology and the structure of the coal gasifier in the prior art, the present invention provides an underground gasifier pre-control structure, a gasifier and a gasification method, where coal masses at both sides of the gasifier are wetted by changing the structure of the coal masses so as to control expansion and spread of the gasifier toward both sides. Furthermore, due to supporting of the wet coal masses at both ends, the stability inside the cavity of the gasifier is improved, and complete structure of the surrounding rocks are maintained, such that the gasifier has good airtightness and bearing capacity during operation, thus achieving stable gasification of the underground coal seams.

One of tasks of the present invention is to provide an underground gasifier pre-control structure in the following technical solution.

There is provided an underground gasifier pre-control structure, including a flame retardant injection system, wherein the flame retardant injection system includes a flame retardant injection shaft pipe channel drilled from ground to a coal seam and a flame retardant injection channel located in the coal seam. The flame retardant injection channel includes a first flame retardant injection channel and a second flame retardant injection channel located at both sides of each gasifier and a third flame retardant injection channel located in a horizontal direction of an adjacent gasifier. The first flame retardant injection channel includes a horizontal section arranged along a strike of the coal seam and a bypass section offset toward the gasifier. The second flame retardant injection channel has the same structure as the first flame retardant injection channel, and the horizontal section of the first flame retardant injection channel and a horizontal section of a second horizontal channel are arranged symmetric about the gasifier.

Several flame retardant injection shaft pipe channels, the bottoms of which are in communication with the first flame retardant injection channel and the second flame retardant injection channel, are disposed.

By injecting a flame retardant solution into the corresponding first flame retardant injection channel, second flame retardant injection channel and third flame retardant injection channel through the flame retardant injection shaft pipe channel, a wet coal wall is formed in the coal seam to achieve pre-control on the gasifier.

The above technical solution directly brings the following beneficial technical effects.

With the construction of the flame retardant injection system, the underground gasification that has not been solved before is pre-controlled and a width for gasification will be reduced to control the cavity of the gasifier to be within the stable scope of the surrounding rocks, helping a mine owner to arrange gasification production flexibly based on specific requirements. Further, the flame retardant injection system itself is a low-cost auxiliary approach. During a process from gas production of the gasifier to shutdown of the gasifier, the costs of the flame retardant injection are very low except for the costs of the drilling, helping the mine owner to control the production costs.

Another task of the present invention is to provide a gasifier.

There is provided an underground gasifier, including an inlet gas shaft pipe channel in a direction from ground to a coal seam, a directional inbuilt horizontal pipe channel arranged horizontally in the coal seam, a return gas shaft pipe channel for gas discharge, and an ignition area, wherein both ends of the directional inbuilt horizontal pipe channel are in communication with the inlet gas shaft pipe channel and the return gas shaft pipe channel. The gasifier further includes the underground gasifier pre-control structure as mentioned above.

The inlet gas shaft pipe channel, the directional inbuilt horizontal pipe channel and the return gas shaft pipe channel form one U-shaped structure; several adjacent gasifiers have a same structure and the several adjacent gasifiers form one gasifier unit and several gasification areas.

The above technical solution directly brings the following beneficial effects.

Due to combination of the flame retardant injection system and the gasifier, artificial control factors are involved in the original unit of gasification process such that the size of the gasifier and the length of the gasification channel can be disposed or flexibly adjusted based on production requirements. Further, the flame retardant injection system can flexibly regulate the production based on a gasification manner in combination with specific geological conditions and work conditions. Moreover, according to different production requirements of the mine owner in different periods, flame retardant injection control is performed for a single gasifier to carry out simultaneous gasification production of multiple production units. Therefore, the flexible combination of the flame retardant injection system and the gasifier can bring obvious conveniences and economic benefits to a production operator.

Further preferably, the above flame retardant injection shaft pipe channel is drilled to a distance from above the coal seam where the gasifier is located, and a shaft support casing is disposed under the flame retardant injection shaft pipe channel.

Further preferably, lengths of the horizontal sections of the first flame retardant injection channel and the second flame retardant injection channel are identical to a length of the directional inbuilt horizontal pipe.

Another task of the present invention is to provide a gasification method of the above underground gasifier, including the following steps sequentially:

a. constructing a single underground gasifier firstly, drilling the inlet gas shaft pipe channel to five meters above a coal seam where the inlet gas shaft pipe channel is located and retreating a drill and reinforcing the inlet gas shaft pipe channel;

secondly, performing horizontal directional drilling operation for the coal seam, wherein a directional drilling length is an advance length to be gasified by the gasifier, and completing the directional inbuilt horizontal pipe channel after completing the drilling, and performing shaft drilling of the return gas shaft pipe channel while performing the horizontal directional drilling operation of the coal seam;

finally, after the directional inbuilt horizontal pipe channel and the return gas shaft pipe channel are communicated, reinforcing the return gas shaft pipe channel so as to complete construction of a single underground gasifier;

b. constructing the flame retardant injection system firstly, drilling the flame retardant injection shaft pipe channel to five meters from above the coal seam and retreating the drill and supporting the flame retardant injection shaft pipe channel;

next, performing horizontal directional drilling along the coal seam, and when the length of the horizontal section of the first flame retardant injection channel is identical to a strike length of the gasifier, completing the drilling of the horizontal section of the first flame retardant injection channel; next, adjusting the drilling direction to enable the drilling direction to be offset toward the gasifier; when the offset reaches a radian, drilling a distance along a tangential direction of a circular arc section where the radian is located, so as to form a bypass section of the first flame retardant injection channel;

then drilling the second flame retardant injection pipe channel based on a method same as the method of constructing the first flame retardant injection pipe channel;

finally, along a direction of a horizontal short section of the coal seam, drilling the third flame retardant injection pipe channel with a length being a sum of horizontal spacings of four adjacent gasifiers and supporting the third flame retardant injection pipe channel in time after completion;

c. completing construction of one unit grid of gasifiers and next, completing construction of other unit grids of gasifiers based on steps a and b;

d. blending an aqueous agent; adding a flame retardant of a given concentration by using a ground flame retardant injection system;

e. coal wetting by injecting the flame retardant: by using the ground flame retardant injection system, injecting the flame retardant into the flame retardant injection shaft pipe channels sequentially and allowing the flame retardant to enter the first flame retardant injection pipe channel, the second flame retardant injection pipe channel, and the third flame retardant injection pipe channel and penetrate into adjacent coal seams, so as to form wetted coal pillars, thus preventing spread upon gasification;

f. ignition for gasification.

Further preferably, in step b, the specific method of drilling the flame retardant injection shaft pipe channel includes: drilling toward the coal seam by using the drill, and when a horizontal distance from the left side of the directional inbuilt horizontal pipe channel is 22 meters and a distance from the bottom of the return gas shaft pipe channel is 10 meters, stopping drilling.

Further preferably, the directional inbuilt horizontal pipe channel is arranged at a ⅓ coal thickness from a floor of the coal seam and paralleled to the coal seam.

Further preferably, in step b, the circular arc section is ¼ length of a circle with a radius less than 22 meters and drilling of 25 meters is performed along a tangential direction of the circular arc section.

Further preferably, magnesium chloride is selected as the flame retardant, and added to the flame retardant injection system to form a flame retardant injection solution with a concentration of 10% to 20%, which is prepared for instant use.

Further preferably, in step b, when the third flame retardant injection pipe channel is constructed, a horizontal directional borehole of the coal seam is enabled to have the same dip angle as the coal seam and is 1.0 to 1.5 meters from a roof of the coal seam where the gasifier is located.

Compared with the prior art, the present invention brings the following beneficial technical effects.

(1) A flame retardant injection system is designed in the pre-control structure of the gasifier of the present invention, and flame spread during gasification of the gasifier is controlled by designing the flame retardant injection system and relevant pipes. Meanwhile, according to design and arrangement of the flame retardant injection pipes in the coal seam, during a gasification process of the coal seam, the gasifier performs gasification only in the wet coal wall formed by the first flame retardant injection pipe, the second flame retardant injection pipe and the third flame retardant injection pipe. With the protection of the flame retardant injection system, design can be carried out by centering around the single gasifier and the use rate of the flame retardant injection pipes of the single gasifier can be increased to maximum by using efficient pipe arrangement and economic flame retardant injection devices. Furthermore, a plurality of gasification units may be operated at the same time, and pipes and flame retardant injection parameters may be flexibly adjusted for the flame retardant injection pipes based on specific production situations to ensure efficient operation of the gasification production.

(2) Due to the support of the wet coal wall, the effect of pre-controlling the structure of the gasifier is achieved. The gasifier is pre-controlled to be the length-to-width ratio of 5:1, and a width of the gasification channel pre-controlled by the gasifier is less than an extreme caving interval of the overlying strata, which will not damage the integrity of the overlying strata nor result in large-area caving of the overlying strata. Thus, the development height of the fissure zone of the overlying strata is further effectively controlled and the bearing capacity and the airtightness of the gasifier are ensured.

(3) The stable gasifier structure further lays foundation for ensuring simultaneous gasification production of a plurality of units of gasifiers, thus solving the problem of insufficient gas production of a single gasifier and the operation instability of the gasifier structure in a continuous gasification process.

(4) With flexible pre-control of the gasifier structure, a plurality of gasification units are enabled to run and reach a design gasification capacity at the same time or a plurality of gasification units may be started at the same time, thus solving the problems of long startup time and long up-to-design-capacity period.

(5) By designing the flame retardant injection system, a gasification size of the gasifier may be pre-controlled.

BRIEF DESCRIPTION OF THE DRAWINGS

The present invention will be further described below in details in combination with the accompanying drawings.

Figure 1:
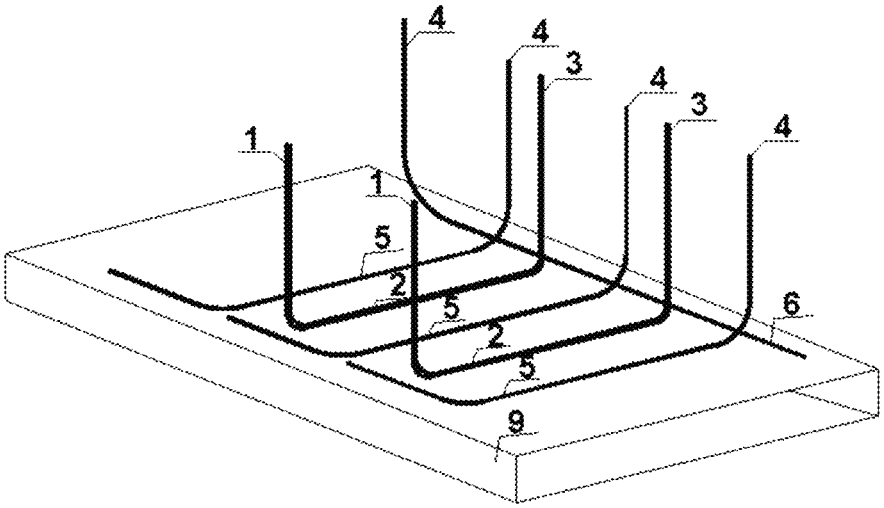
FIG. 1 is a schematic diagram illustrating a gasifier pre-control structure according to the present invention.

Numerals of the drawings are described below: 1. inlet gas shaft pipe channel, 2. directional inbuilt horizontal pipe channel, 3. return gas shaft pipe channel, 4. flame retardant injection shaft pipe channel, 5. first flame retardant injection channel, 6. third flame retardant injection channel, 7. coal pillar wetted by flame retardant injection, 8. gasifier gasification area, and 9. coal seam.

DETAILED DESCRIPTION OF THE EMBODIMENTS

The present invention provides an underground gasifier pre-control structure, a gasifier and a gasification method. In order to make the advantages and technical solutions of the present invention clearer, the present invention will be further described in details in combination with specific embodiments.

The first flame retardant injection channel 5 mentioned in the present invention is a directional flame retardant injection channel of a horizontal long section of a coal seam, and the third flame retardant injection channel 6 is a directional flame retardant injection channel of a horizontal short section of the coal seam.

The underground gasifier pre-control structure of the present invention is used to solve the problem of inability to control a gasifier. The stable gasifier structure lays foundation for ensuring simultaneous gasification production of a plurality of units of gasifiers, thus solving the problem of insufficient gas production of a single gasifier and the operation instability of the gasifier structure in a continuous gasification process.

Specifically, in the prior art, the gasifier is difficult to control in structure and morphology during a gasification process. The major technical difficulties are as follows: when the underground gasifier performs gasification after being ignited, the downhole is basically in uncontrolled state and the gasification continuously expands outwardly after ignition.

In order to solve the above technical problems, the present invention creatively designs a flame retardant injection system. With the detailed designing of the structure of the flame retardant injection system, a coal mine flame retardant (selecting magnesium chloride) of a given concentration may be injected into a coal seam by using the flame retardant injection system and the coal mine flame retardant will stay in the coal seam to protect the wet coal wall against failure of structure control due to water high temperature evaporation.

As shown in FIGS. 1 to 6, the underground gasifier pre-control structure includes a flame retardant injection system. The flame retardant injection system includes a flame retardant injection shaft pipe channel drilled from ground to a coal seam and a flame retardant injection channel located in the coal seam. The flame retardant injection channel includes a first flame retardant injection channel and a second flame retardant injection channel located at both sides of each gasifier and a third flame retardant injection channel located in a horizontal direction of an adjacent gasifier. The first flame retardant injection channel includes a horizontal section arranged along a strike of the coal seam and a bypass section offset toward the gasifier; the second flame retardant injection channel has the same structure as the first flame retardant injection channel, and the horizontal section of the first flame retardant injection channel and a horizontal section of a second horizontal channel are arranged symmetric about the gasifier; several flame retardant injection shaft pipe channels, the bottoms of which are in communication with the first flame retardant injection channel and the second flame retardant injection channel, are disposed; by injecting a flame retardant solution into the corresponding first flame retardant injection channel, second flame retardant injection channel and third flame retardant injection channel through the flame retardant injection shaft pipe channel, a wet coal wall is formed in the coal seam to achieve pre-control on the gasifier.

The above pre-control structure is applied to an underground gasifier to achieve structure control. The main principle is that the implementation is carried out by combining the above flame retardant injection system with the coal wetting of the flame retardant injection. Firstly, detailed descriptions are made to the gasifier including the above pre-control structure.

Provided is an underground gasifier including an inlet gas shaft pipe channel in a direction from ground to a coal seam, a directional inbuilt horizontal pipe channel arranged horizontally in the coal seam, a return gas shaft pipe channel for gas discharge, and an ignition area, wherein both ends of the directional inbuilt horizontal pipe channel are in communication with the inlet gas shaft pipe channel and the return gas shaft pipe channel.

The inlet gas shaft pipe channel, the directional inbuilt horizontal pipe channel and the return gas shaft pipe channel form one U-shaped structure; several adjacent gasifiers have a same structure and the several adjacent gasifiers form one gasifier unit and several gasification areas.

The first flame retardant injection channel, the second flame retardant injection channel, the third flame retardant injection channel and the flame retardant injection shaft pipe channel in the above flame retardant injection system are respectively arranged at corresponding positions of the gasifier with details referred to the following embodiment.

Embodiment 1

A single underground gasifier is constructed.

As shown in FIGS. 1 to 4, firstly, the inlet gas shaft pipe channel 1 is drilled to five meters above a coal seam where the inlet gas shaft pipe channel is located and a shaft casing drill is retreated; a shaft casing is lowered to reinforce the stability of the casing wall structure to prepare for lowering a directional drill later. After an inlet channel casing is adjusted, a coal seam directional drill is lowered to perform horizontal directional drilling operation of the coal seam based on geological data and the requirements of the mine owner. It is required that the horizontal gasification channel is arranged at a ⅓ coal thickness from a floor of the coal seam and paralleled to the coal seam. A directional drilling length is an advance length to be gasified by the gasifier. Therefore, the length of the directional inbuilt horizontal pipe channel 2 may be set based on specific situations and is set to 150 meters in this embodiment. When the horizontal directional drilling of the coal seam is performed, shaft drilling of the return gas shaft pipe channel 3 is performed at the same time by using a machine same as that for drilling the inlet gas shaft pipe channel 1. After the directional inbuilt horizontal pipe channel 2 and the return gas shaft pipe channel 3 are communicated, a shaft support casing is lowered for the return gas shaft pipe channel 3 to prepare for gas extraction. Until now, a single U-shaped gasifier is completed.

Based on the above method, other gasifiers are constructed, and one gasifier unit is formed by using several gasifiers.

As a major innovative point of the present invention, the flame retardant injection system is constructed in the following process.

Firstly, the flame retardant injection shaft pipe channel 4 is drilled by using a drill same as that for drilling the inlet gas shaft pipe channel.

Figure 3:
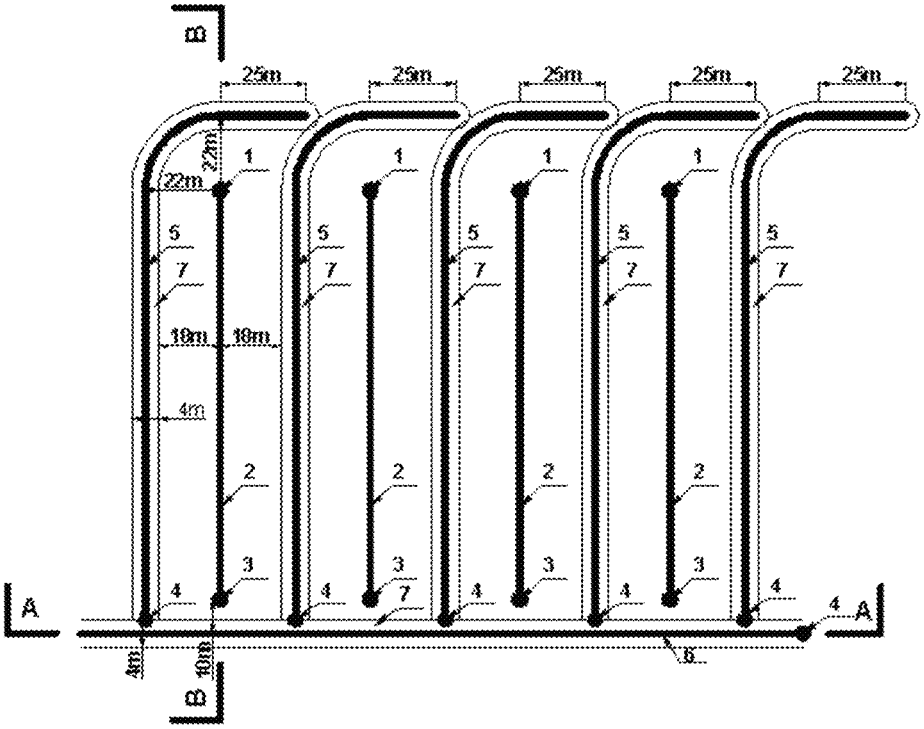
FIG. 3 is a structural top view of each unit in FIG. 2.
Figure 4:
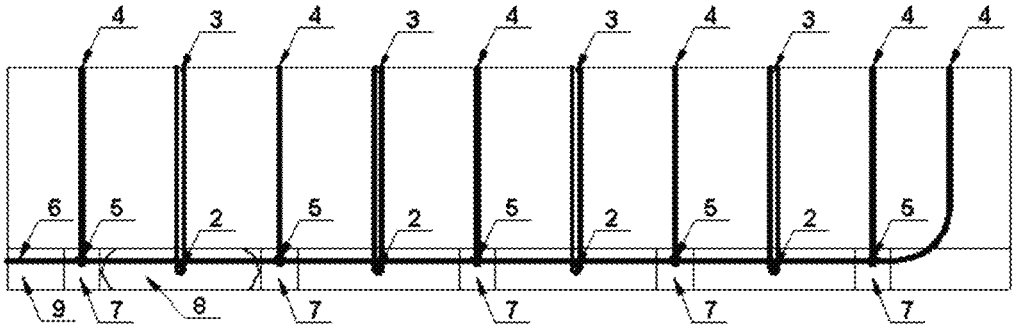
FIG. 4 is a sectional view taken along A-A in FIG. 3.
Figure 5:
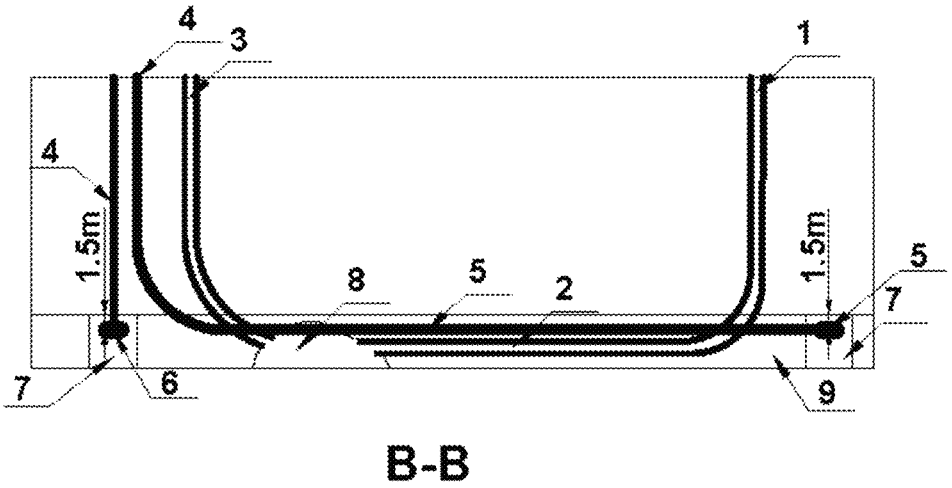
FIG. 5 is a sectional view taken along B-B in FIG. 3.

The drill lowering position of the flame retardant injection shaft pipe channel 4 is as shown in FIG. 3, and is 22 meters from the left side of the directional inbuilt horizontal pipe channel 2 of the gasifier and 10 meters from the lower side of the return gas shaft pipe channel 3. When the flame retardant injection shaft pipe channel 4 is drilled to five meters from above the coal seam, the shaft casing drill is retreated, and the shaft support casing is lowered for use in flame retardant injection.

Further, the coal seam horizontal directional drill is lowered to drill the horizontal section of the first flame retardant injection channel and the drill is same as that for drilling the directional inbuilt horizontal pipe channel.

The specific drilling method is described below.

It is required that the directional borehole of the horizontal long section of the coal seam is arranged to serve the flame retardant injection as possible. Therefore, the horizontal directional borehole of the coal seam should have the same dip angle as the coal seam if possible, and is 1.0 to 1.5 meters from the roof of the coal seam where the gasifier is located. In order to improve the wetting effect, the borehole angle is adjusted to +4° with an azimuth angle of 90° by using an ignition gasification working face as reference. The length of the horizontal directional borehole of the flame retardant injection pipe may be determined based on the number of gasification channels and the strike length of the coal seam. When the length of horizontal straight section of the flame retardant injection pipe is identical to the strike length of the gasifier, the drilling of the horizontal straight section is completed and directional adjustment is to be made to the directional drill. When the drilling is performed to 122 meters from the inlet gas shaft pipe channel, the drilling direction is adjusted to offset to the inner side of the gasifier, as shown in FIG. 3, offset 90 degrees rightward and the channel forms ¼ circular arc section with a radius less than 22 meters. When the drilling of the ¼ circle is completed, drilling of 25 meters is continued forward along a tangential direction of the circular arc so as to basically form the flame retardant injection pipe at the side of the gasifier. After the directional borehole is drilled, the support casing is lowered in time to achieve supporting effect for the bare channel, thus avoiding clogging resulting from channel collapse. The pipe diameter of the support casing needs to be determined based on the size of the horizontal directional drill of the coal seam and may be slightly smaller than a hole diameter of the directional borehole. The water discharge hole of the flame retardant injection support casing is opened in the following method: eight water discharge holes with a hole diameter of 5 mm are opened along the circumference of the support casing with an interval of 45° angle, where the axis spacing of the holes is 0.5 m to allow the circular holes to be staggered by 60°.

After the first flame retardant injection channel is constructed, the construction of the second flame retardant injection channel is continued based on the same method as the first flame retardant injection channel. As shown in FIG. 3, after the leftmost flame retardant injection pipe channel is constructed, the right flame retardant injection pipe channel is constructed, and the drill lowering position of its flame retardant injection shaft pipe channel 4 is 22 meters from the right side of the directional inbuilt horizontal pipe channel 2 and 10 meters from the lower side of the return gas shaft pipe channel 3. The arrangement is basically symmetric distribution about the gasifier. Next, the equipment technology and method requirements same as those for constructing the previous flame retardant injection pipe channels are used. As shown in FIG. 3, the flame retardant injection pipe channels at both sides of and the upper part of the gasifier are completed and then, in order to enable the pre-control for the gasifier structure to be more perfect, it is required to construct the structure of the other side, that is, the directional flame retardant injection channel 6 of the horizontal short section of the lower part coal seam as shown in FIG. 3 is constructed.

Figure 2:
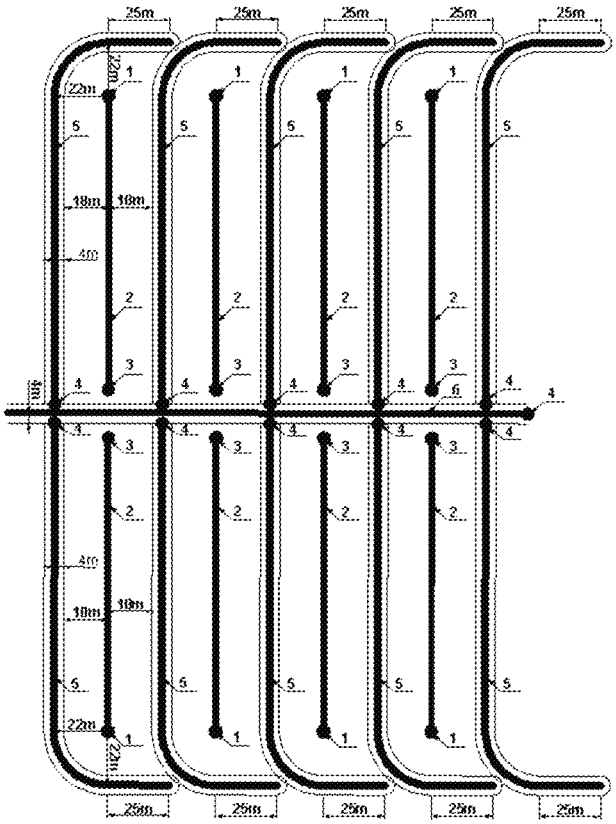
FIG. 2 is a structural top view of FIG. 1.

Finally, the third flame retardant injection pipe channel 6 is constructed, that is, the directional flame retardant injection channel of the horizontal short section of the coal seam is constructed. As shown in FIG. 3, after a first unit grid of gasifiers are constructed, it is required to construct the flame retardant injection channel of the lower end, where the drill for drilling the flame retardant injection shaft pipe channel is same as previously-used equipment. The drill lowering position of the flame retardant injection shaft pipe channel 4 may be determined based on specific situations. But, in order to enable the well to be fully utilized and reduce additional unnecessary drilling wastes, it is preferred that the length of the directional flame retardant injection channel 6 of the horizontal short section of the coal seam is four times a width of a short side of the gasifier. Therefore, detailed descriptions are made firstly based on FIG. 3. The drill lowering position of the flame retardant injection shaft pipe channel 4 is 40 meters rightward from the leftmost fourth gasifier, and 4 meters from below the flame retardant injection shaft pipe channels at both sides of the gasifier. When the flame retardant injection shaft pipe channel 4 is drilled to five meters above the coal seam where the gasifier is located, the shaft pipe channel drill is retreated and the shaft support casing is lowered. Next, by using the directional drilling machine of the coal seam, the directional flame retardant injection channel 6 of the horizontal short section of the coal seam is constructed. It is required that the horizontal directional borehole of the coal seam is enabled to have the same dip angle as the coal seam if possible and is 1.0 to 1.5 meters from the roof of the coal seam where the gasifier is located. In order to improve the wetting effect, the borehole angle is adjusted to +4° with an azimuth angle of 0° by using an ignition gasification working face as reference, so as to perform straight section drilling. When the drilling is performed to the same position at the left side of the leftmost gasifier shown in FIG. 3 as the flame retardant injection shaft pipe channel 4, drilling is stopped, the directional drill of the coal seam is retreated, and the support casing for flame retardant injection is lowered in time. At this time, pipe arrangement required for structure pre-control around one unit of gasifiers is basically completed. In order to solve the problem of insufficient gas production of one single gasifier, a plurality of gasifiers are required to perform gasification at the same time. Therefore, it is required to construct a generation system and a flame retardant injection system. As shown in FIG. 2, by using a designed regional gasifier production system, the utilization rate of the flame retardant injection system can reach the optimum, that is, the two wings in FIG. 2 can share the directional flame retardant injection channel 6 of the horizontal short section of the coal seam at the same time, so as to accelerate the construction of the gasifier structure, reduce the number of the boreholes, and save the costs.

After the above flame retardant injection system is constructed, it is further required to perform coal wetting of flame retardant injection so as to control the structure and morphology of the gasifier during a gasification process.

The step of the coal wetting of flame retardant injection specifically includes the followings: the flame retardant injection pipe which is a flexible high pressure inlet water rubber pipe woven by steel wire is lowered; the flame retardant injection pipe is disposed as one pipe of sufficient length, saving connection steps; meanwhile, due to less joints, frictional force in the casing is reduced, and the flame retardant injection pipe is directly introduced into the support casing of the flame retardant injection channel.

The coal mine flame retardant (selecting magnesium chloride) of a given concentration is added to the injected water to prepare a flame retardant injection solution of a concentration of 10% to 20%. After the solution is injected into the coal seam, the coal mine flame retardant will stay in the coal seam to protect the wetted coal wall against failure of structure control due to water high temperature evaporation.

The larger the flame retardant injection pressure is, the larger the wetting radius is. In actual applications, limited by factors such as pressure supply devices, pipes and production costs, the flame retardant injection pressure is not allowed to increase unlimitedly. The flame retardant injection time is also to be controlled. Too long flame retardant injection time may result in wastes of the aqueous solvent, especially result in wastes of coal resources due to excessively large coal pillars 7 wetted by the flame retardant injection in the coal seam, but a short time cannot achieve a wetting effect.

Therefore, the flame retardant injection time and the flame retardant injection pressure may be determined based on a coal thickness and a coal quality of the coal seam where the gasifier is located. For a thin or medium thick coal seam, a constant pressure flame retardant injection of 5 MPa is selected. In order to ensure the injection amount of the flame retardant of the coal seam 9, each hole is injected with the flame retardant for no less than 12 hours but no greater than 24 hours. For a thick or ultra-thick hard coal seam, an intermittent high and low pressure alternating flame retardant injection mode may be selected to perform intermittent high and low pressure alternating flame retardant injection with a low water pressure of 3 MPa and a high water pressure of 9 MPa. Such flame retardant injection mode forms a phenomenon like "impact", such that a coal mass expands and shrinks in volume continuously, leading to the strength fatigue of the coal mass. In this way, the degree of fracture of the coal mass is increased and connectivity of the fissures of the coal mass is increased, thus directly forming many new small fissures in the coal seam and greatly improving the efficiency of the flame retardant injection.

Figure 6:
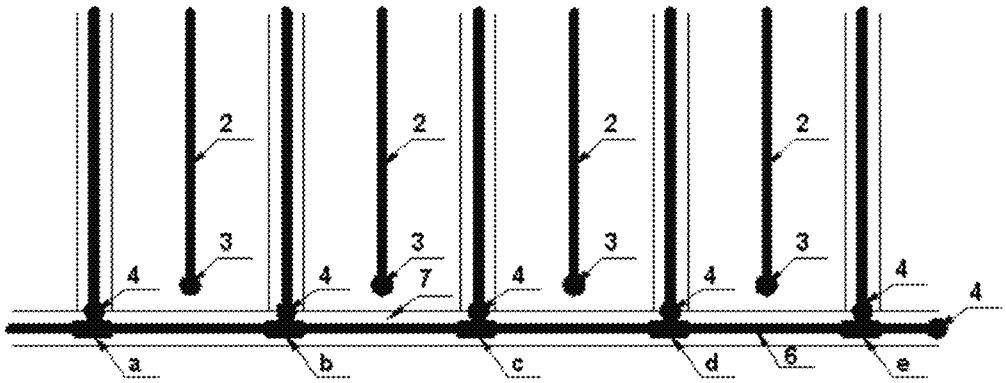
FIG. 6 is a schematic diagram illustrating sectional borehole packing of flame retardant injection.

After the flame retardant injection is completed, borehole packing is the key to ensure good effect of the flame retardant injection of the coal seam. Since the borehole packer matches the borehole and can bear a given pressure, an expanding cement may be used to perform physical borehole packing with a packing depth of more than 1.5 m. As shown in FIG. 6, for the directional flame retardant injection channel 5 of the horizontal long section of the coal seam at the left side of the unit of gasifiers, expanding cement borehole packing may be performed sequentially after flame retardant injection is completed. For the directional flame retardant injection channel 5 of the horizontal long section of the coal seam at the right side of the gasifier, valve-off operation is performed to wait for a next gasifier to share the flame retardant injection channel. For the directional flame retardant injection channel 6 of the horizontal short section of the coal seam, sectional borehole packing operation is performed. In FIG. 6, when the left first gasifier is ignited to perform gasification, borehole packing protection of a section a is carried out in advance. After the first gasifier completes flame retardant injection, borehole packing is continued for a section b. After the first gasifier is extinguished, flame retardant injection is continued and so on. In this way, the directional flame retardant injection channel 6 of the horizontal short section of the coal seam can be protected from wasting the aqueous solvent due to excessive length, and further, due to presence of sections, the flame retardant injection time, the flame retardant injection pressure and the flame retardant injection flowrate can be controlled more accurately.

After the flame retardant injection pipes are arranged, and borehole packing and coal wetting are completed by flame retardant injection, ignition can be performed for gasification so as to perform gasification production in the gasification area of the gasifier 8. A gasification unit body can be determined based on requirements. It is required that the gasifiers on both wings perform flame retardant injection and coal wetting at the same time and carry out ignition for gasification. In this way, it is convenient to perform gas collection management of the gasifier and carry out centralized management for the flame retardant injection pipes. Valve control is performed between the flame retardant injection pipes which are connected with a time meter, a flow meter, a pressure gauge, and a relief valve, so as to enable the operation of the flame retardant injection to be more accurate, more efficient and safer.

It is noted that, without contrary descriptions herein, the terms such as "upper", "lower", "left", and "right" indicate the directions shown in the drawings of the present invention.

Those parts not mentioned in the present invention may be referred to the prior art for implementation.

It is noted that, any equivalents or obvious variations made by those skilled in the part under the teaching of the present invention shall all fall within the scope of protection of the present invention.

The invention claimed is:

1. A gasification method of an underground gasifier, wherein the underground gasifier comprises an inlet gas shaft pipe channel in a direction from ground to a coal seam, a directional inbuilt horizontal pipe channel arranged horizontally in the coal seam, a return gas shaft pipe channel for gas discharge, and an ignition area, wherein both ends of the directional inbuilt horizontal pipe channel are in communication with the inlet gas shaft pipe channel and the return gas shaft pipe channel, and the underground gasifier further comprises: an underground gasifier pre-control structure, wherein the underground gasifier pre-control structure comprises: a flame retardant injection system, wherein the flame retardant injection system comprises a flame retardant injection shaft pipe channel drilled from ground to a coal seam and a flame retardant injection channel located in the coal seam, the flame retardant injection channel comprises a first flame retardant injection channel and a second flame retardant injection channel located at both sides of each gasifier and a third flame retardant injection channel located in a horizontal direction of an adjacent gasifier, the first flame retardant injection channel comprises a horizontal section arranged along a strike of the coal seam and a bypass section offset toward the gasifier; the second flame retardant injection channel has the same structure as the first flame retardant injection channel, and the horizontal section of the first flame retardant injection channel and a horizontal section of a second horizontal channel are arranged symmetric about the gasifier;

several flame retardant injection shaft pipe channels, bottoms of shaft pipe channels are in communication with the first flame retardant injection channel and the second flame retardant injection channel, are disposed;

by injecting a flame retardant solution into the corresponding first flame retardant injection channel, second flame retardant injection channel and third flame retardant injection channel through the flame retardant injection shaft pipe channel, a wet coal wall is formed in the coal seam to achieve pre-control on the gasifier; and the inlet gas shaft pipe channel, the directional inbuilt horizontal pipe channel and the return gas shaft pipe channel form one U-shaped structure; several adjacent gasifiers have a same structure and the several adjacent gasifiers form one gasifier unit and several gasification areas, the gasification method of the underground gasifier, sequentially comprising the following steps:

a. constructing a single underground gasifier:

firstly, drilling the inlet gas shaft pipe channel to five meters above a coal seam where the inlet gas shaft pipe channel is located and retreating a drill and reinforcing the inlet gas shaft pipe channel;

secondly, performing horizontal directional drilling operation for the coal seam, wherein a directional drilling length is an advance length to be gasified by the gasifier, and completing the directional inbuilt horizontal pipe channel after completing the drilling, and performing shaft drilling of the return gas shaft pipe channel while performing the horizontal directional drilling operation of the coal seam; and finally, after the directional inbuilt horizontal pipe channel and the return gas shaft pipe channel are communicated, reinforcing the return gas shaft pipe channel so as to complete construction of a single underground gasifier;

b. constructing the flame retardant injection system:

firstly, drilling the flame retardant injection shaft pipe channel to five meters from above the coal seam and retreating the drill and supporting the flame retardant injection shaft pipe channel;

next, performing horizontal directional drilling along the coal seam, and when the length of the horizontal section of the first flame retardant injection channel is identical to a strike length of the gasifier, completing the drilling of the horizontal section of the first flame retardant injection channel; next, adjusting the drilling direction to enable the drilling direction to be offset toward the gasifier; when the offset reaches a radian, drilling a distance along a tangential direction of a circular arc section where the radian is located, so as to form a bypass section of the first flame retardant injection channel;

then drilling the second flame retardant injection pipe channel based on a method same as the method of constructing the first flame retardant injection pipe channel; and finally, along a direction of a horizontal short section of the coal seam, drilling the third flame retardant injection pipe channel with a length being a sum of horizontal spacings of four adjacent gasifiers and supporting the third flame retardant injection pipe channel in time after completion;

wherein the specific method of drilling the flame retardant injection shaft pipe channel comprises: drilling toward the coal seam by using the drill, and when a horizontal distance from the left side of the directional inbuilt horizontal pipe channel is 22 meters and a distance from the bottom of the return gas shaft pipe channel is 10 meters, stopping drilling, wherein the circular arc section is ¼ length of a circle with a radius less than 22 meters and drilling of 25 meters is performed along a tangential direction of the circular arc section, and wherein when the third flame retardant injection pipe channel is constructed, a horizontal directional borehole of the coal seam is enabled to have the same dip angle as the coal seam and is 1.0 to 1.5 meters from a roof of the coal seam where the gasifier is located;

c. completing construction of one unit grid of gasifiers and next completing construction of other unit grids of gasifiers based on steps a and b;

d. blending an aqueous agent: adding a flame retardant of a given concentration by using a ground flame retardant injection system;

e. coal wetting by injecting the flame retardant: by using the ground flame retardant injection system, injecting the flame retardant into the flame retardant injection shaft pipe channels sequentially and allowing the flame retardant to enter the first flame retardant injection pipe channel, the second flame retardant injection pipe channel, and the third flame retardant injection pipe channel and penetrate into adjacent coal seams, so as to form wetted coal pillars, thus preventing spread upon gasification, for a thin or medium thick coal seam, a constant pressure flame retardant injection of 5 MPa is selected, for a thick or ultra-thick hard coal seam, an intermittent high and low pressure alternating flame retardant injection mode is selected to perform intermittent high and low pressure alternating flame retardant injection with a low water pressure of 3 MPa and a high water pressure of 9 MPa, such flame retardant injection mode forms an impact, such that a coal mass expands and shrinks in volume continuously, leading to strength fatigue of the coal mass, in this way, a degree of fracture of the coal mass is increased and a connectivity of a fissures of the coal mass is increased, thus directly forming a plurality of new small fissures in the coal seam and greatly improving the efficiency of the flame retardant injection, and after the flame retardant injection is completed, for the third flame retardant injection channel, sectional borehole packing operation is performed; and f. ignition for gasification.

2. The gasification method of an underground gasifier according to claim 1, wherein the flame retardant injection shaft pipe channel is drilled to a distance from above the coal seam where the gasifier is located, and a shaft support casing is disposed under the flame retardant injection shaft pipe channel.

3. The gasification method of the underground gasifier according to claim 2, wherein lengths of the horizontal sections of the first flame retardant injection channel and the second flame retardant injection channel are identical to a length of the directional inbuilt horizontal pipe.

4. The gasification method of the underground gasifier according to claim 3, wherein the directional inbuilt horizontal pipe channel is arranged at a ⅓ coal thickness from a floor of the coal seam and paralleled to the coal seam.

5. The gasification method of the underground gasifier according to claim 4, wherein magnesium chloride is selected as the flame retardant, and added to the flame retardant injection system to form a flame retardant injection solution with a concentration of 10% to 20%, which is prepared for instant use.

* * * * *